United States Patent [19]

Muller et al.

[11] Patent Number: 4,492,604

[45] Date of Patent: Jan. 8, 1985

[54] SALT BATH FOR NITRIDING IRON MATERIALS

[75] Inventors: Johannes Muller, Frankfurt am Main; Helmut Kunst, Rodenbach; Christian Scondo, Hanau, all of Fed. Rep. of Germany

[73] Assignee: Degussa Aktiengesellschaft, Frankfurt, Fed. Rep. of Germany

[21] Appl. No.: 435,401

[22] Filed: Oct. 20, 1982

[30] Foreign Application Priority Data

Oct. 24, 1981 [DE] Fed. Rep. of Germany ..... 3142318

[51] Int. Cl.[3] ..... C21D 1/48

[52] U.S. Cl. ..... 148/15.5; 148/28

[58] Field of Search ..... 148/15, 15.5, 20, 27, 148/28

[56] References Cited

U.S. PATENT DOCUMENTS

| | | | |
|---|---|---|---|
| 2,875,095 | 2/1959 | Muller | 148/15 |
| 3,507,757 | 4/1970 | Caubet et al. | 148/15 |
| 4,019,928 | 4/1977 | Beyer et al. | 148/15.5 |
| 4,055,446 | 10/1977 | Kunst et al. | 148/15 |
| 4,292,094 | 9/1981 | Kunst et al. | 148/6.11 |

FOREIGN PATENT DOCUMENTS

| | | | |
|---|---|---|---|
| 656607 | 4/1965 | Belgium | 148/15.5 |
| 1052424 | 3/1959 | Fed. Rep. of Germany | 148/15.5 |
| 2310815 | 9/1974 | Fed. Rep. of Germany . | |
| 2934113 | 4/1981 | Fed. Rep. of Germany . | |

*Primary Examiner*—John P. Sheehan

*Attorney, Agent, or Firm*—Cushman, Darby & Cushman

[57] ABSTRACT

Low cyanide nitriding salt baths which are composed of alkali cyanate and alkali carbonate and used for treating components made of steel and iron produce coatings on the surface of the component in some cases and can lead to problems in the use of the components. A satisfactory surface quality can be obtained from nitriding salt baths which additionally contain 0.5 to 100 ppm of selenium.

24 Claims, No Drawings

SALT BATH FOR NITRIDING IRON MATERIALS

BACKGROUND OF THE INVENTION

The invention is directed to a salt bath for nitriding components made of steel and iron, the bath consisting essentially of cyanides, cyanates and carbonates of the alkali metals having a cyanide content between 0.01 and 3% $CN^-$.

Nitriding salt baths today are used world wide to improve the wear properties and the fatigue strength of components made of iron and steel. The salt bath process is also finding increasing use for improving the corrosion resistance of the surface of components made of iron and steel, whereby the development of a special salt bath for cooling the parts after nitriding (German OS No. 2,934,113 and related Kunst U.S. Pat. No. 4,292,094 has led to the fact that the nitride compound layer's own corrosion properties can clearly still be improved. The entrie disclosure of Kunst is hereby incorporated by reference and relied upon). Therewith the process of salt bath nitriding has gained great significance also for areas of use where otherwise there is required the use of expensive chromium.

For the purpose of salt bath nitriding baths which contained a high portion of cyanide were originally used. The cyanate needed for the nitriding was produced by aeration, furthermore these baths were operated in titanium crucibles.

The increasing requirement of an ecologically acceptable process have led to the fact that the high cyanide containing salt baths have been replaced by baths practically free of cyanide, whereby by using an organic compound for the regeneration of the bath, the formation of toxic wastes has been eliminated, (German OS 2310815 and related Beyer U.S. Pat. No. 4,019,928, the entire disclosure of which is hereby incorporated by reference and relied upon).

Since cyanide has a strongly reducing action in nitriding baths at temperatures between 550° C. and 650° C., cyanates on the other hand rather have a tendency to release oxygen, the nitriding baths containing only a small amount of cyanide occasionally have the tendency to strongly oxidize the nitride compound layer so that even after the cooling and washing of the component, there remains on the surface a difficult to remove dusty coating. Frequently such coatings are not acceptable for the further use of the nitrided component since they, e.g. with hydraulic aggregates, contaminate the oil and can lead to abrasive wear and tear at susceptible areas, e.g. in the bearings. In order to avoid this type of effect, time consuming cleaning of the components is frequently necessary.

Furthermore rusty red surface coatings can form when components are treated in this type of nitriding bath.

A nitriding bath in the described unacceptable condition—with regard to the surface—is characterized, inter alia, by the fact that a steel foil made from a steel containing 0.05% carbon shows a loss of weight in the order of e.g. some 100 mg/dm$^2$ when treated for 90 minutes in the salt bath. On the other hand a steel foil of the same composition will show an increase in weight of e.g. 70 mg/mm$^2$ when treated in a bath which does not show the detrimental condition. However, previously it was not possible to determine beforehand when a bath produced good results and when it produced non-acceptable results in regard to surface cleanliness.

Such baths previously had to be brought into good working condition by overheating the bath for a certain period and thoroughly desludging it so that the components treated afterwards had an acceptable surface quality. However, the bath giving good results remained in that state for only a short time and thereafter the procedure had to be repeated.

Therefore it was the task of the present invention to provide a salt bath for the nitriding of components made of iron and steel consisting essentially of alkali metal cyanide, alkali metal cyanate and alkali metal carbonate (e.g. sodium and potassium cyanides, cyanates and carbonates) having a cyanide content of between 0.01 and 3% $CN^-$ which did not produce surface coatings on the nitrided components even after long operation.

SUMMARY OF THE INVENTION

This task is solved according to the invention by adding to the bath containing the alkali metals cyanide, cyanate and carbonate 0.5 to 100 ppm of selenium in the form of selenium compounds such as selenium dioxide, sodium selenide, sodium selenite and potassium selenite.

Thereby the selenium or selenium compounds can be added directly to the operating salt bath or to the salts during their production.

Preferably the cyanate content (calculated as $CNO^-$) is 25 to 45 weight % and the bath temperature between 550° and 650° C. Furthermore, it is advantageous to use a salt bath crucible which is as free as possible from iron. Thereby crucibles made of titanium, or chrome alloys or of nearly iron free-chromium-nickel alloys, which can even contain up to 10 weight % iron have proven good.

The content of selenium or selenium compounds of the invention permanently prevents the formation of coatings on the surface of the nitrided components in the nitriding salt baths.

Unless otherwise indicated all parts and percentages are by weight.

The compositions can comprise essentially of or consist of the stated materials.

The following examples explain the nitriding salt bath of the invention in more detail.

EXAMPLE 1

A salt bath according to the description of the invention was operated in an electrically heated furnace in a titanium crucible having the dimension 35/70 cm. The bath had the following composition: 38% $CNO^-$, 0.5% $CN^-$, about 15% carbonate, balance sodium and potassium.

A steel foil having a carbon content of 0.05% treated in this bath for 90 minutes and cooled in water showed a weight loss of 185 mg/dm$^2$. Steel components treated at the same time exhibited a black coating on the surface which could be wiped off.

With the help of a ladle about 1.44 grams of $SeO_2$ corresponding to 12 ppm elemental selenium were added to the bath.

A foil test carried out as above but after the addition of the selenium resulted in weight increase of around 51 mg/dm$^2$. Steel components treated at the same time had a light grey surface completely free from coating. The favourable effect of this selenium addition was maintained for many weeks.

EXAMPLE 2

1.86 gram of sodium selenite (this corresponds to 8.5 ppm of elemental selenium) was added to a nitriding salt bath according to Example 1 which was in a condition characterized by a weight loss of the steel foil. The foil then treated therein showed a weight increase. The treated components also showed a clean surface.

EXAMPLE 3

14.4 grams of selenium dioxide were added to a production charge of 1 metric ton of the above mentioned salt. Using such a salt for the make up of a salt bath according to Example 1 showed no detrimental effects with regard to the surface. The steel foil treated in such a salt bath showed no loss in weight.

The entire disclosure of German priority application No. P3142318.3 is hereby incorporated by reference.

What is claimed is:

1. A salt bath suitable for nitriding components made of iron and steel consisting essentially of at least one alkali metal cyanide, alkali metal cyanate and alkali metal carbonate and having a cyanide content of between 0.01 and 3% $CN^-$ and also containing 0.5 to 12 ppm of selenium in the form of elemental selenium or a selenium compound.

2. A salt bath according to claim 1 wherein the $CNO^-$ content is 25 to 45% CNO.

3. A salt bath according to claim 2 having a temperature between 550° and 650° C.

4. A salt bath according to claim 1 having a temperature between 550° and 650° C.

5. A salt bath according to claim 3 wherein the selenium compound is elemental selenium, alkali metal selenite or selenium dioxide.

6. A salt bath according to claim 2 wherein the selenium compound is elemental selenium, alkali metal selenite or selenium dioxide.

7. A salt bath according to claim 1 wherein the selenium compound is elemental selenium, alkali metal selenite or selenium dioxide.

8. A salt bath according to claim 2 containing selenium dioxide or sodium selenite.

9. A salt bath according to claim 1 containing selenium dioxide or sodium selenite.

10. A salt bath according to claim 1 containing 9.94 to 12 ppm of selenium.

11. A salt bath according to claim 1 containing 12 ppm of selenium.

12. A salt bath according to claim 1 containing 9.94 ppm of selenium.

13. A salt bath according to claim 1 containing 10.2 ppm of selenium.

14. A salt bath according to claim 1 consisting of at least one-alkali metal cyanide, alkali metal cyanate, alkali metal carbonate and elemental selenium or a selenium compound.

15. A method of nitriding iron or steel comprising carrying out the nitriding in a salt bath consisting essentially of at least one alkali metal cyanide, alkali metal cyanate and alkali metal carbonate and having a cyanide content of between 0.01 and 3% $CN^-$ and also containing a 0.5 to 12 ppm of selenium in the form of elemental selenium or a selenium compound.

16. A method according to claim 15 wherein the nitriding is carried out at 550° C. to 650° C.

17. A method according to claim 16 wherein the salt bath has a $CNO^-$ content of 25 to 45% $CNO^-$.

18. A method according to claim 17 wherein the nitriding is carried out in a crucible made of titanium or chromium-nickel alloy containing up to 10% iron.

19. A method according to claim 17 wherein the selenium compound is elemental selenium, alkali metal selenite or selenium dioxide.

20. A combination consisting essentially of a salt bath suitable for nitriding compounds made of iron and steel consisting essentially of at least one alkali metal cyanide, alkali metal cyanate and alkali metal carbonate and having a cyanide content of between 0.01 and 3% $CN^-$ and also containing 0.5 to 12 ppm of selenium in the form of elemental selenium or a selenium compound in a crucible made of titanium or chromium-nickel alloy containing up to 10% iron.

21. A combination according to claim 20 wherein $CNO^-$ content is 25 to 45%.

22. A combination according to claim 21 having a temperature between 550° and 650° C.

23. A combination according to claim 20 having a temperature between 550° and 650° C.

24. A combination according to claim 20 consisting of at least one alkali metal cyanide, alkali metal cyanate, alkali metal carbonate and elemental selenium or a selenium compound in a crucible made of titanium or chromium nickel alloy containing up to 10% iron.

* * * * *